US010101124B2

(12) United States Patent
Patton

(10) Patent No.: US 10,101,124 B2
(45) Date of Patent: Oct. 16, 2018

(54) SCOPE ADAPTED FOR SHORT AND LONG RANGE ZEROING

(71) Applicant: Edward Patton, Rochester, NY (US)

(72) Inventor: Edward Patton, Rochester, NY (US)

( * ) Notice: Subject to any disclaimer, the term of this patent is extended or adjusted under 35 U.S.C. 154(b) by 0 days.

(21) Appl. No.: 15/272,407

(22) Filed: Sep. 21, 2016

(65) Prior Publication Data

US 2018/0080738 A1 Mar. 22, 2018

(51) Int. Cl.
*F41G 1/54* (2006.01)
*F41G 1/38* (2006.01)
*F41G 11/00* (2006.01)

(52) U.S. Cl.
CPC ..... *F41G 1/545* (2013.01); *F41G 1/38* (2013.01); *F41G 11/003* (2013.01)

(58) Field of Classification Search
CPC ... F41G 1/38; F41G 1/54; F41G 1/545; F41G 11/001; G03B 29/00
USPC ..... 42/120, 119, 122, 124
See application file for complete search history.

(56) References Cited

U.S. PATENT DOCUMENTS 5,442,860 A * 8/1995 Palmer ..... F41G 1/545 33/286
6,000,163 A 12/1999 Gordon
6,584,720 B1 * 7/2003 Johnson ..... F41G 1/545 42/120
6,862,833 B1 * 3/2005 Gurtner ..... F41G 1/545 42/120
6,886,287 B1 * 5/2005 Bell ..... F41G 1/54 33/334
7,346,400 B2 * 3/2008 Cross ..... F41G 1/345 42/119
8,950,102 B1 * 2/2015 Reardon ..... F41G 1/38 42/120
9,322,616 B2 4/2016 Craven et al.
2004/0231220 A1 * 11/2004 McCormick ..... F41G 1/473 42/120
2009/0049733 A1 * 2/2009 Matthews ..... F41G 1/38 42/122
2017/0211911 A1 * 7/2017 Hidock ..... F41G 1/38

* cited by examiner

*Primary Examiner* — Michael David
(74) *Attorney, Agent, or Firm* — Tracy Jong Law Firm; Tracy P. Jong; Cheng Ning Jong

(57) ABSTRACT

A device adapted for zeroing of a projectile device having a first scope, the device including a second scope; and an adaptor for securing the second scope to the projectile device. Further disclosed is a method for zeroing a projectile device having a first scope and a second scope, the method including: adjusting the aim of the projectile device by aiming a reticle of the second scope at the center of a bullseye at a target plane disposed at a distance; firing a first shot of the projectile device to create a first point of impact at the target plane; and aiming a reticle of the first scope at the center of the point of impact, wherein a subsequent shot fired from the projectile device is configured to impact a second point of impact aimed at with the reticle of the first scope at the target plane.

13 Claims, 20 Drawing Sheets

SCOPE ADAPTED FOR SHORT AND LONG RANGE ZEROING

BACKGROUND OF THE INVENTION

1. The Field of the Invention

The present invention relates to a device and method for short and long range zeroing of a projectile device. More specifically, the present invention is directed to a scope configured to be coupled to a scope-equipped projectile device for short and long range zeroing or a pair of scopes configured to be coupled to a projectile device for short and long range zeroing.

2. Background Art

Zeroing of a weapon at great distances can be a great challenge as various zeroing aids may provide references impacted by diffusion at great distances. For instance, in a zeroing system relying upon one or more projected reference points at a target plane, the size of the projected beams grow exponentially with distance. The footprint of a projected beam may be suitably focused at close range, e.g., 25 yards, however, at great distances, e.g., 1000 yards, the projected footprint can be unacceptably large. Therefore, prior art zeroing devices are typically utilized for zeroing projectile devices for target distances not exceeding 25 yards. A small deviation in the direction in which a projected beam points results in a large deviation in distance. Therefore, a projectile device or weapon that is meant to be used for targets at great distances, e.g., hundreds of yards or more, may only be zeroed for 25 yards. In zeroing for distances deviating from 25 yards, a generic ballistic table is then relied upon for bullet drop (an effect of gravity on bullet) of the weapon. Ballistic tables are typically made available by weapon manufacturers to their customers. Such tables are built using data collected from new and well serviced weapons, i.e., the bores of the weapons have not experienced a large number of shots, the bullets used are of a certain type, make and quality and the materials used for manufacturing the barrels are of specific batches, etc. Although the manufacturing process of weapons of the same make and model is standard, numerous factors can affect strict adherence of product dimensions and parameters. For instance, although manufacturing processes can be standardized and audited, there remains sufficient opportunities for making weapons having parts with critical dimensions that vary or making weapons with materials hardening processes that are slightly different but considered acceptable when used to manufacture a weapon for purposes of everyday shooting. A weapon that is zeroed for a short distance, e.g., 25 yards, may require adjustment not only in bullet drop but also in the yaw angle of the weapon when used for other target distances. Therefore, with prior art zeroing devices and methods, it would have been impossible to zero certain weapons for longer range shooting as the weapons may require adjustments that may not be taught by extrapolating information from a generic ballistic table for the weapons. For bullet drop adjustments, one may custom build a custom ballistic table that charts horizontal bullet distances with respect to vertical bullet drop distances. However, such activity still does not consider or yield a yaw adjustment that may be required.

There still exists a need for a zeroing system and method that is applicable to a large range as prior art zeroing systems and methods are only satisfactory when applied to short range zeroing, e.g., up to 25 yards and calibration of a short-range zeroed weapons using ballistic tables do not yield satisfactory results.

SUMMARY OF THE INVENTION

In accordance with the present invention, there is provided a device adapted for zeroing a projectile device having a first scope having a first optical axis, the zeroing device including:

(a) a second scope having a second optical axis; and (b) an adaptor for securing or coupling the second scope to the projectile device.

In one embodiment, the adaptor is configured for securing the second scope to the first scope of the projectile device such that the second optical axis is parallel to the first optical axis.

In another embodiment, the adaptor includes an extension rod having a first end and a second end, a first clamp disposed on the first end for securing the extension rod to the second scope and a second clamp disposed on the second end. The second clamp is configured for removably securing the extension rod to the first scope.

In one embodiment, the second clamp includes a Picatinny rail adaptor.

In another embodiment, the adaptor includes an extension rod having a first end and a second end, a clamp, the extension rod extending at the first end from the second scope and the clamp is disposed on the second end. The second clamp is configured for removably securing the second scope to one of the first scope and the projectile device.

In another embodiment, the adaptor includes two clamps configured for securing the second scope to the first scope of the projectile device or the projectile device. The two clamps are configured to be spaced apart a distance, the distance is configured to be adjustable.

In one embodiment, the second scope further includes a parallax elimination aid. In one embodiment, the parallax elimination aid of the second scope includes a second reticle configured to be paired with a first reticle of the second scope, the second reticle having a center coinciding with the second optical axis.

In one embodiment, the present device further includes a parallax elimination aid adapted to the first scope. In one embodiment, the parallax elimination aid of the first scope includes a second reticle configured to be paired with a first reticle of the first scope, the second reticle having a center coinciding with the first optical axis.

In accordance with the present invention, there is further provided a device adapted for zeroing a projectile device, the device including:

(a) a first scope having a first optical axis; and (b) a second scope having a second optical axis disposed parallel to the first optical axis.

In one embodiment, the present device further includes a parallax elimination aid adapted to the first scope. In one embodiment, the parallax elimination aid of the first scope includes a second reticle configured to be paired with a first reticle of the first scope, the second reticle having a center coinciding with the first optical axis. In one embodiment, the present device further includes a parallax elimination aid adapted to the second scope. In one embodiment, the parallax elimination aid of the second scope includes a second reticle configured to be paired with a first reticle of the second scope, the second reticle having a center coinciding with the second optical axis.

In accordance with the present invention, there is further provided a method for zeroing a projectile device having a first scope and a second scope, the method including:

(a) adjusting the aim of the projectile device by aiming a reticle of the second scope at the center of a bullseye at a target plane disposed at a distance;

(b) firing a first shot of the projectile device to create a first point of impact at the target plane; and (c) aiming a reticle of the first scope at the center of the point of impact, wherein a subsequent shot fired from the projectile device is configured to impact a second point of impact aimed at with the reticle of the first scope at the target plane.

In one embodiment, the distance is a distance of up to about 300 yards. In one embodiment, the adjusting step further includes aligning a reticle of the second scope with a parallax eliminating aid.

In one embodiment, the aiming step further includes aligning a reticle of the second scope with a parallax eliminating aid.

In accordance with the present invention, there is further provided a method for zeroing a projectile device having a first scope and a second scope, the method including:

(a) adjusting the aim of the projectile device by aiming a reticle of the first scope at the center of a bullseye at a target plane disposed at a distance and firing a first shot of the projectile device to create a first point of impact at the target plane;

(b) holding the aim of the reticle of the first scope at the center of the bullseye at the target plane and aiming a reticle of the second scope at the center of the bullseye at the target plane; and (c) holding the aim of the reticle of the second scope at the center of the bullseye and aiming the reticle of the first scope at the center of the point of impact, wherein a subsequent shot fired from the projectile device is configured to impact a second point of impact aimed at with the reticle of the first scope at the target plane.

An object of the present invention is to provide a system and method for zeroing a projectile device for distances previously not possible with other zeroing systems and methods.

Another object of the present invention is to provide a system and method for zeroing a projectile device where the distance for which the projectile device is zeroed does not affect the effectiveness of the system and method.

Another object of the present invention is to provide a system and method for zeroing a projectile device for practical distances for which the projectile device is used such that the projectile device is not required to be bullet drop adjusted based on a generic ballistic table of the projectile device which may not be accurate for the projectile device.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
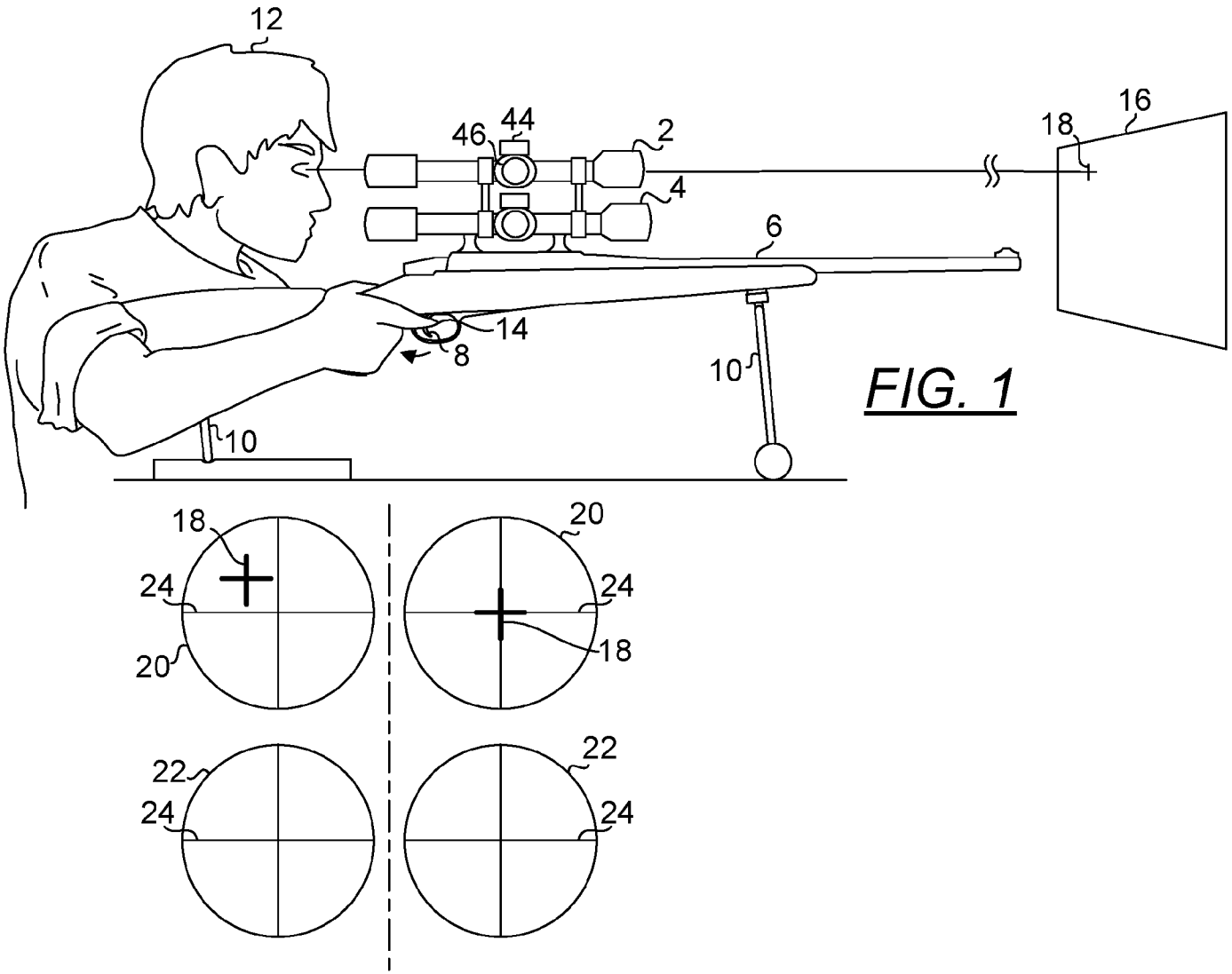
FIGS. 1-4 are diagrams depicting a series of steps taken for zeroing a projectile device, wherein a side view of a second scope is shown adapted for use with zeroing, a target as it is aligned with the second scope and corresponding views through the second scope and a first scope to which the second scope is attached in each of the figures.

2—secondary or second telescope
4—primary or first telescope
6—projectile device
8—trigger
10—shooting rest

12—shooter
14—shooter's hand
16—target plane
18—bullseye
20—view through secondary telescope
22—view through primary telescope
24—reticle
26—point of impact
28—optical axis
30—distance between optical axes of first and second scopes
32—adaptor
34—clamp
36—rail
38—rod
40—image erecting optics
41—reticle
42—parallax elimination aid
44—horizontal adjustment turret
46—vertical adjustment turret

PARTICULAR ADVANTAGES OF THE INVENTION

The present zeroing device allows zeroing to be performed for a range that is not previously achievable with prior art zeroing devices. The present zeroing device takes advantage of the use of a telescope for zeroing and therefore the range for which a projectile device can be zeroed is not limited by the spread of a projected beam at a distance which can cause the user to struggle to determine centers of one or more references or improperly proportioned references due to their distances from the eye which can obscure the user's view of the target.

When combined with parallax mitigating devices or parallax elimination aids, the present zeroing device can be used for zeroing a projectile device at any distance as the distance for which the projectile device is zeroed does not affect the effectiveness of the system and method. Each of the scopes used in the present zeroing device does not need to be made specifically for the distance to which the projectile device is zeroed. Therefore scopes of any focal distance can be used for zeroing a projectile device for any distance.

Prior art systems and methods for zeroing a projectile device by projecting beams of light from the projectile device onto a target and utilizing the location of these marked dots to establish, maintain or indicate the physical relationship of the weapon to the target, are susceptible to many factors, including but not limited to: power depletion of a projection device of the projecting beams, visibility of the projecting beams in the bright sunlight, temperature (both excessive and lack of heat), inadequate definition of dot size and growth of dot size as range increases rendering the dot too large to be precise, imprecise accuracy, recoil, limited magnification of target, limited effective range (25 yards or less) and barrel size, configuration and alignment with bore. The present device overcomes all of the challenges of prior art systems and methods.

In one embodiment, the present device is capable of being adapted to an existing projectile device or an existing scope of an existing projectile device via a quick connect mechanism, e.g., Picatinny rail adaptor, etc.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

FIGS. 1-4 are diagrams depicting a series of steps taken for zeroing a projectile device, wherein a side view of a second scope is shown adapted for use with zeroing, a target as it is aligned with the second scope and corresponding views through the second scope and a first scope to which the second scope is attached in each of the figures. Each of FIGS. 1-8 depicts a physical configuration of a weapon as used by a shooter who aims his weapon at a target area and a single set of views through the two scopes or two sets of time-lapsed views through the scopes. Each scope 2, 4 is essentially a telescope. The terms "scope" and "telescope" may be used interchangeably herein to generally mean an optical instrument designed to make distant objects appear nearer. A telescope is configured such that the cross-hair or another sight indicator appears clear at the distance that corresponds to its specified magnification factor. For instance, with a telescope view setting of 25 yards, an object disposed at this distance as well as the cross hair will appear clear to the user. In all instances shown herein, a projectile device is preferably supported with a shooting rest for stability and repeatability upon recoil after firing of the projectile device.

In one embodiment, a telescope is a mechanical device having mechanical components (e.g., ocular and objective lenses and image erecting optics, etc.) interposed between a viewer/user of the telescope and a target such that the target appears closer to the user via a line of sight directly through the telescope. In another embodiment, a telescope is a digital scope. References shall be made to U.S. Pat. No. 6,000,163 to Gordon and U.S. Pat. No. 9,322,616 to Craven et al. for digital scopes. A digital scope is defined herein as a device capable of capturing images and displaying them on a digital screen, e.g., a Liquid Crystal Display (LCD) or a Light-Emitting Diode (LED) in real-time or near real-time. In one instance, no direct line of sight of a target is permitted through a digital scope. Various indicia, marks, symbols or generally, sight aids, may be appropriately overlaid on the screen with target images to represent one or more reticles whose positions on the screen correspond to adjustment devices of the scope. In another instance, direct line of sight of a target is possible through the scope. Again, various sight aids may be appropriately overlaid on the screen with target images to facilitate aiming. In another embodiment, a night vision-enabled telescope (via thermal imaging) is used for applications in low light. Phosphorous tracer rounds may be used to further cause illumination of points of impact (as viewed through the night vision-enabled telescope) although conventional bullets may create sufficient illumination at points of impact.

Figure 2:
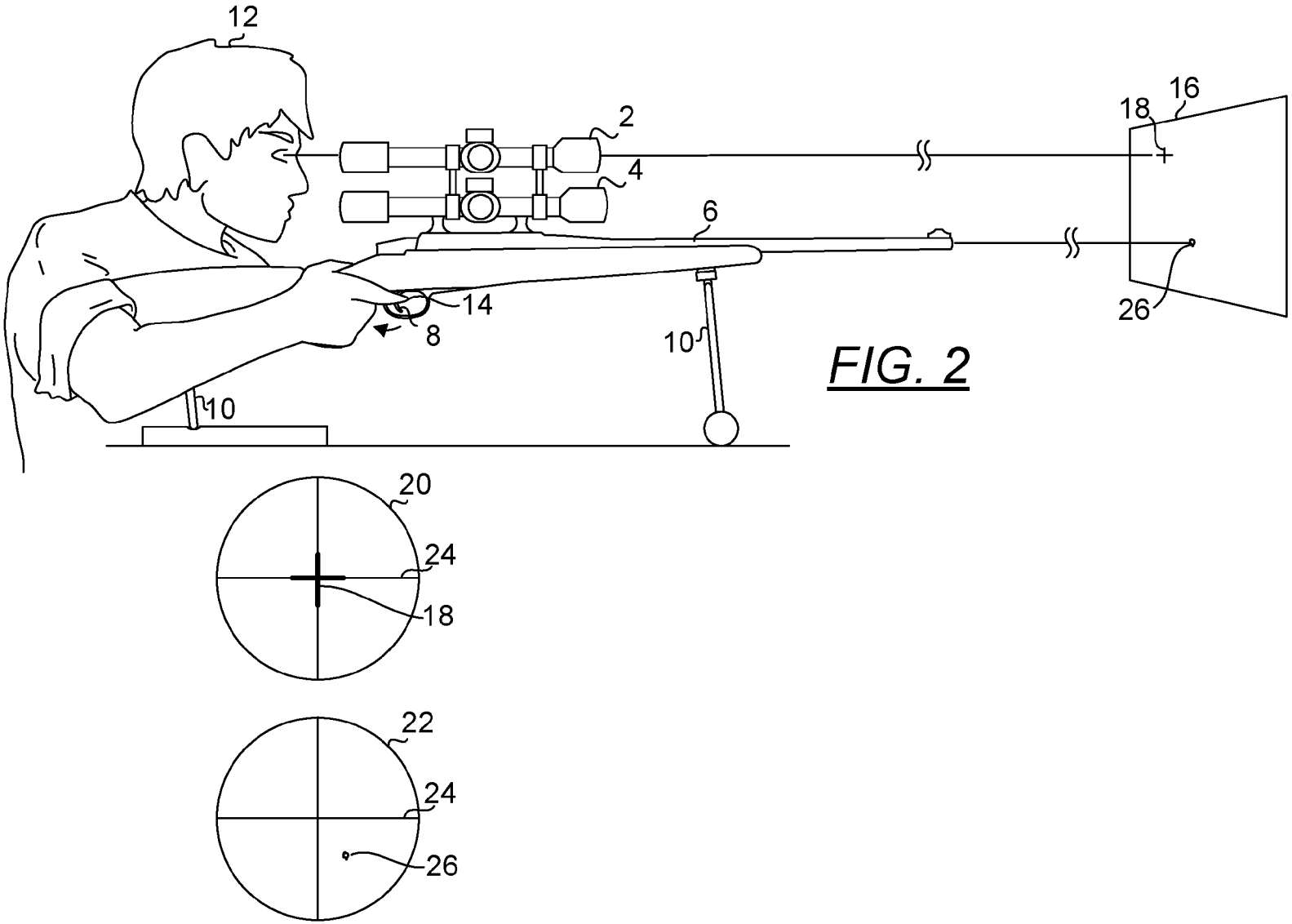
Figure 3:
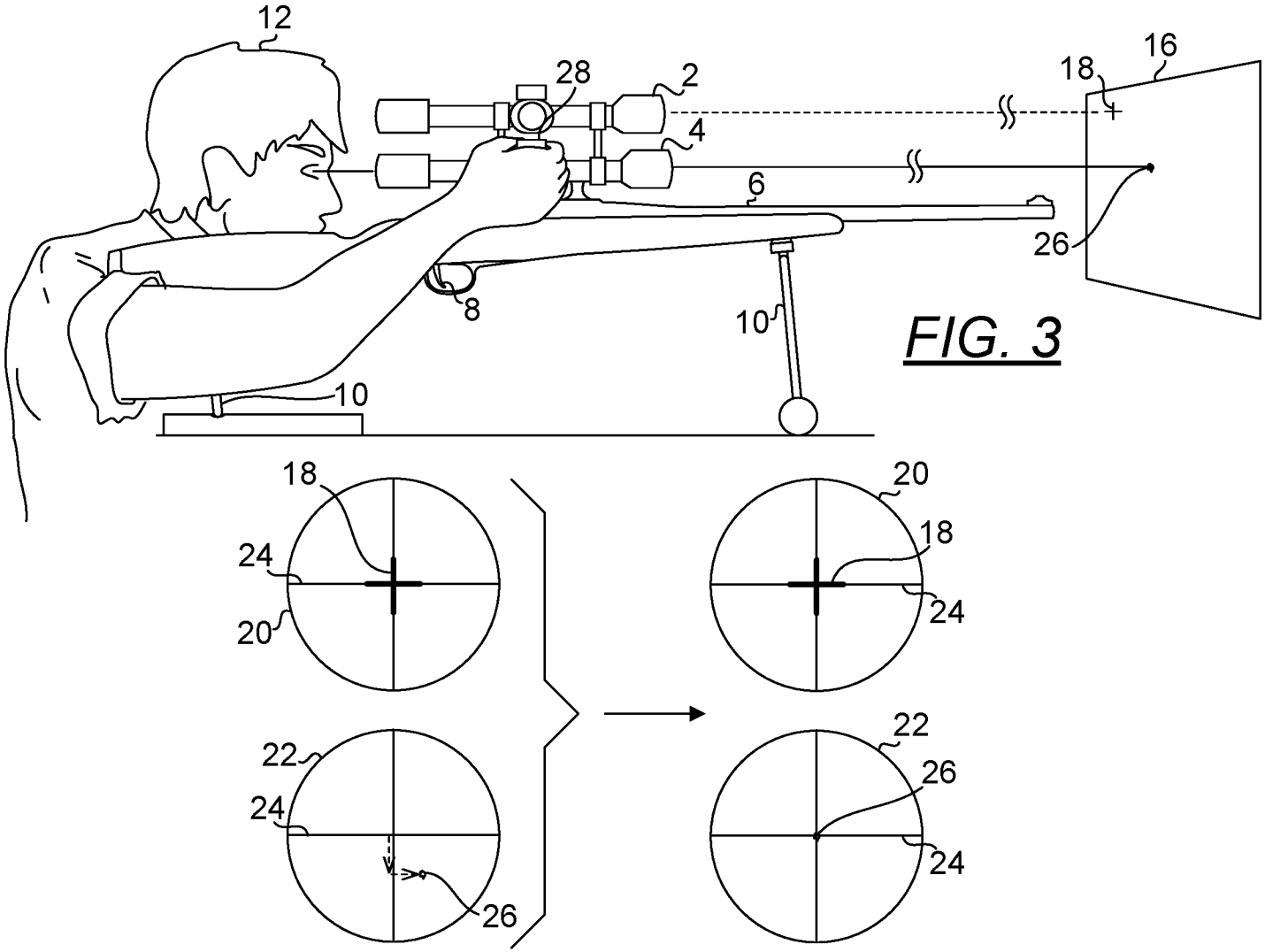
Figure 4:
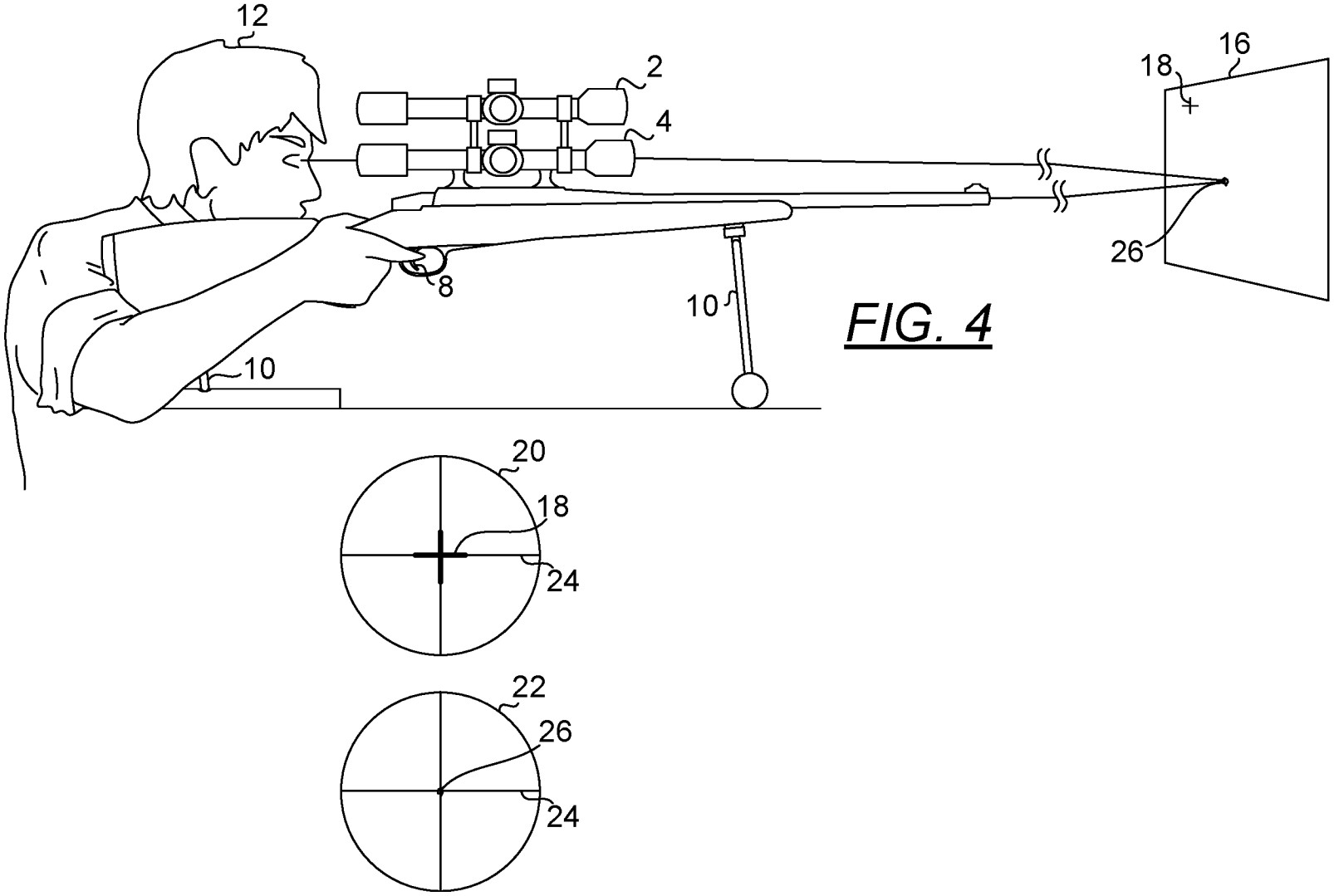

Each of FIGS. 1-4 depicts a second scope 2 that is mounted atop a first scope 4. In FIG. 1, a bullseye 18 disposed at a target plane 16 appears in the view 20 through the second scope as shown on the set of views on the left. It shall be noted that a reticle 24 is disposed in each of the scopes 2, 4. The set of views on the right shows the result of aiming the reticle 24 of the second scope 2 at the center of a bullseye at a target plane 16 disposed at a distance by making adjustments via a horizontal adjustment turret 44 and a vertical adjustment turret 46 of the second scope 2. The bullseye can include, but not limited to, a pair of crosshairs or any mark or marks capable of indicating the location of their physical center. The horizontal adjustment turret 44 allows adjustment of the reticle horizontally to coincide with the bullseye 18 while the vertical adjustment turret 46 allows adjustment of the reticle vertically to coincide with the bullseye 18. In the configuration shown, the shooter 12 may access the horizontal adjustment turret 44 easily via a right hand or a left hand. As the vertical adjustment turret 46 is disposed on the right hand side of the shooter 12, it may be easier for the shooter 12 to use his right hand to access the vertical adjustment turret 46. However, if the shooter 12 desires a left-handed vertical adjustment, the second scope 2 may be rotated such that the horizontal adjustment turret 44 will now function as a vertical adjustment turret and the vertical adjustment turret 46 will now function instead as a horizontal adjustment turret. Referring to FIG. 2, upon having aimed the reticle 24 of the second scope 2 at the center of a bullseye at a target plane 16, the shooter 12 proceeds to fire a first shot of the projectile device to create a first point of impact 26 at the target plane 16 as shown in the view through the first scope. Referring now to FIG. 3, the reticle 24 of the first scope is aimed at the center of the point of impact 26. The set of views on the left depict a process where horizontal and vertical adjustments are being made via horizontal and vertical adjustment turrets, respectively, such that the reticle 24 coincides with the point of impact 26 as shown on the set of views on the right. The zeroing of the projectile device 6 is now complete. FIG. 4 is a view depicting a subsequent shot being fired from the projectile device. It shall be noted that the shot impacts a second point of impact aimed at with the reticle of the first scope at the target plane 16 where the second point of impact coincides with the first point of impact 26.

Figure 5:
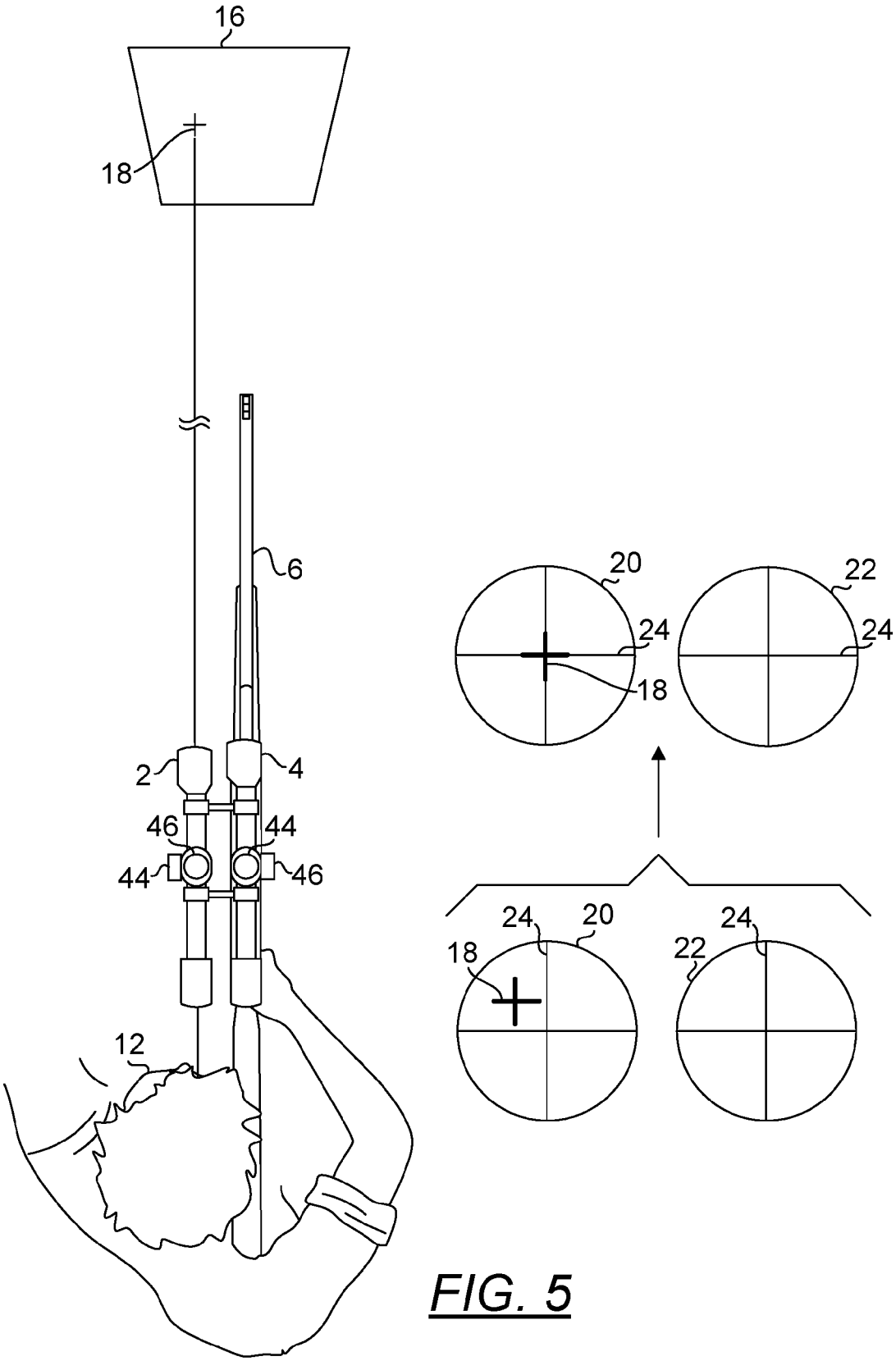
FIGS. 5-8 are diagrams depicting a series of steps taken for zeroing a projectile device, wherein a top view of a second scope is shown adapted for use with zeroing, a target as it is aligned with the second scope and corresponding views through the second scope and a first scope to which the second scope is attached in each of the figures.
Figure 6:
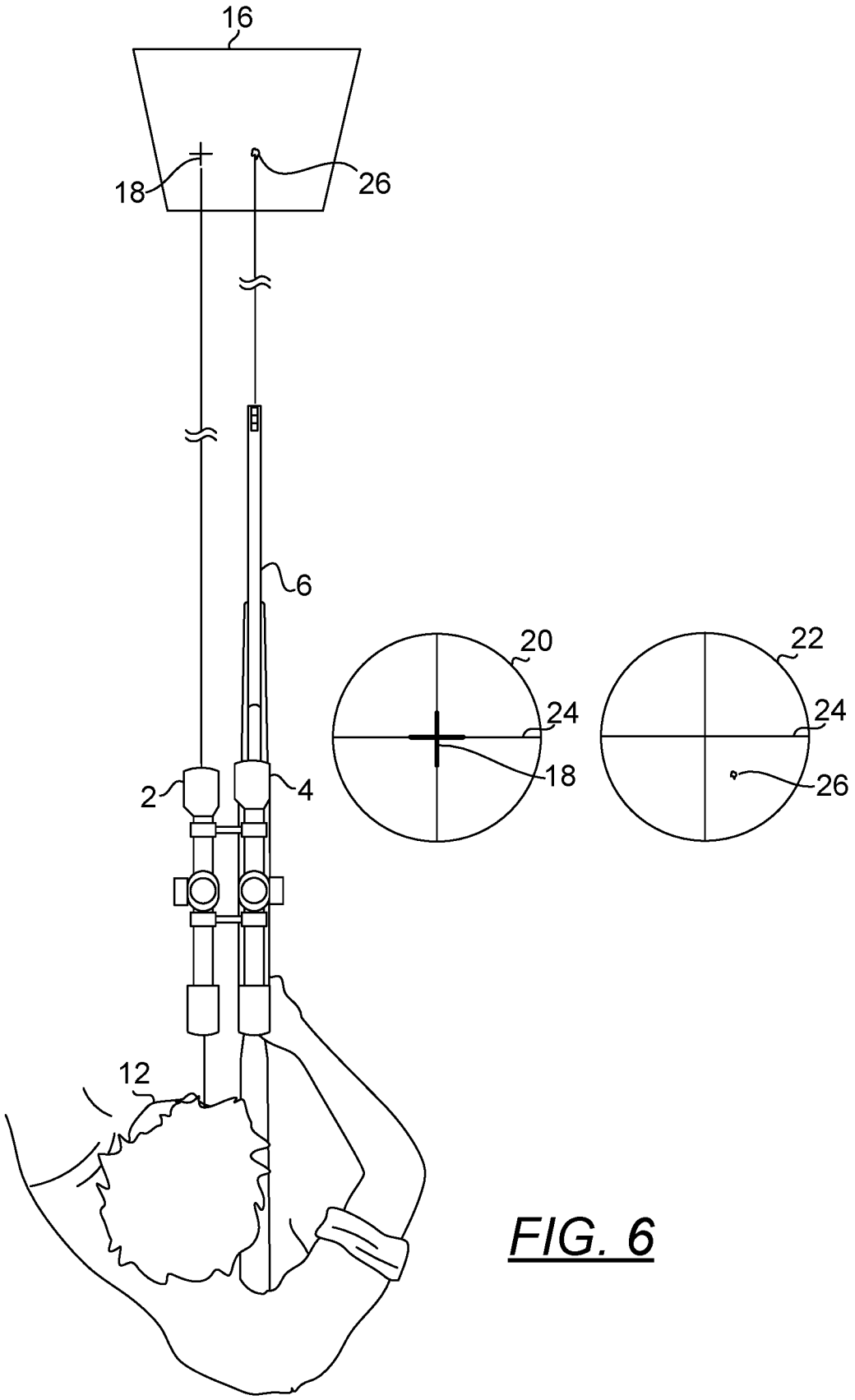
Figure 7:
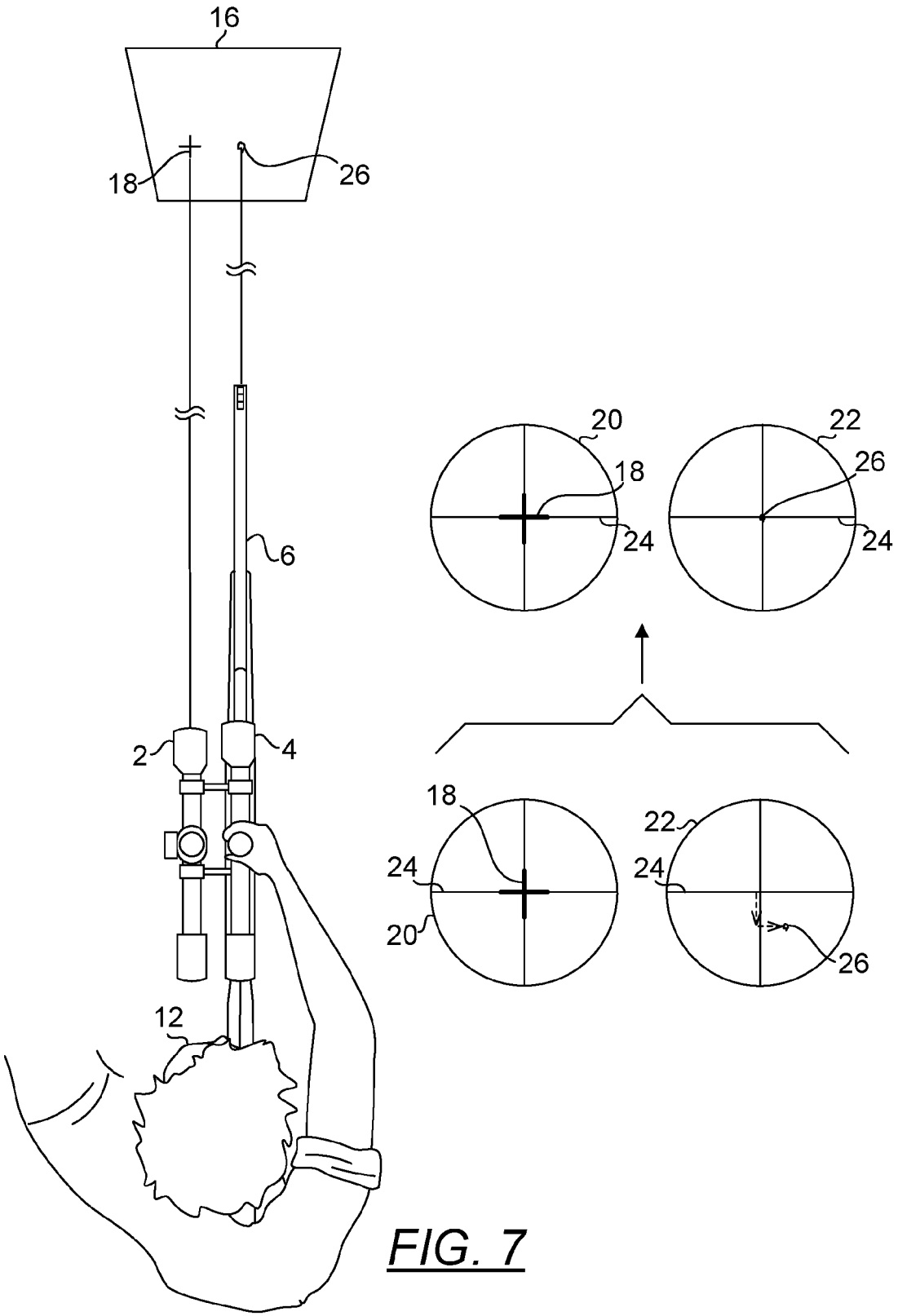
Figure 8:
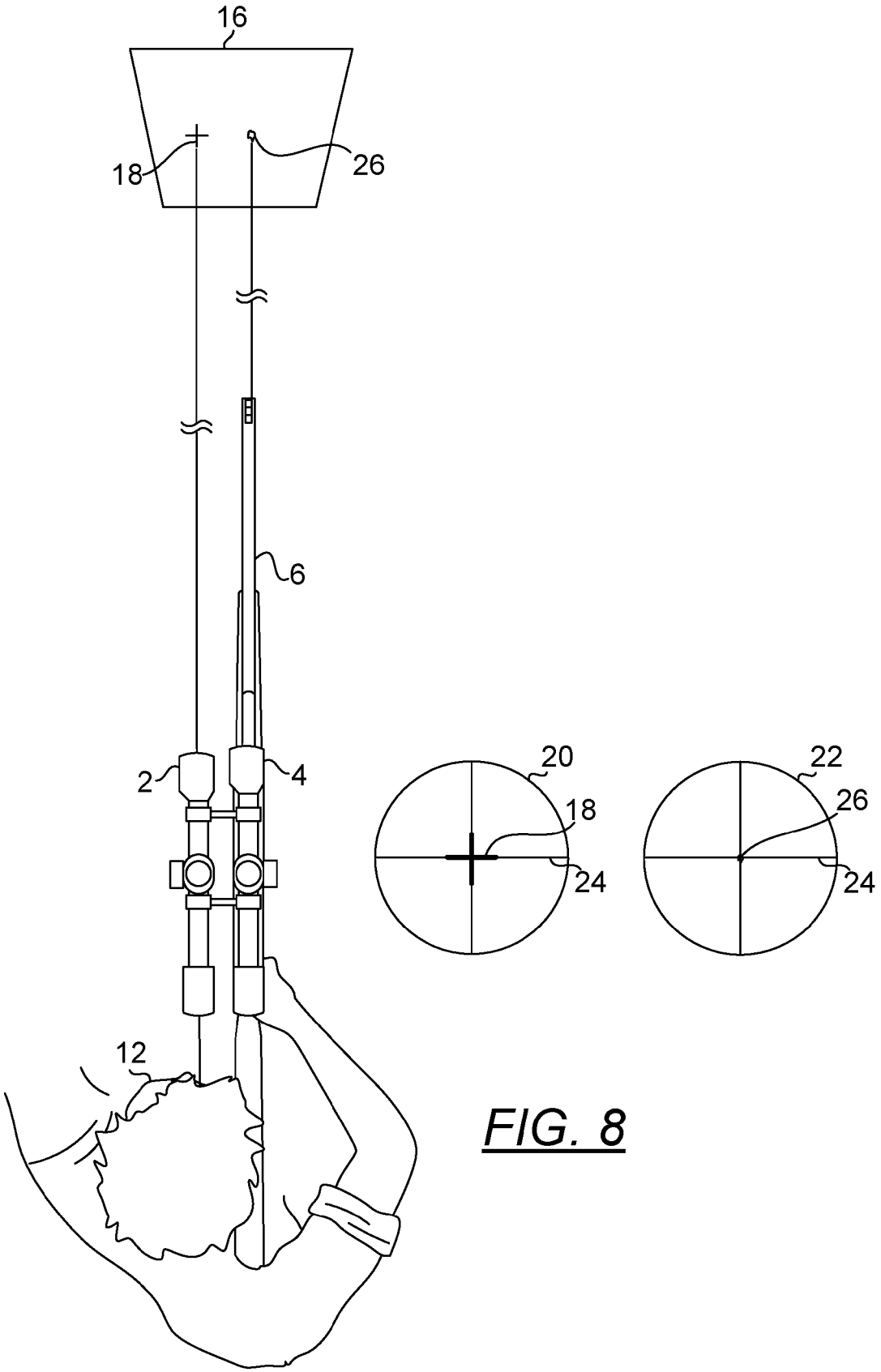

FIGS. 5-8 are diagrams depicting a series of steps taken for zeroing a projectile device, wherein a top view of a second scope is shown adapted for use with zeroing, a target as it is aligned with the second scope and corresponding views through the second scope and a first scope to which the second scope is attached in each of the figures. Each of FIGS. 5-8 depicts a second scope 2 that is mounted alongside a first scope 4. In FIG. 5, a bullseye 18 disposed at a target plane 16 appears in the view 20 through the second scope as shown on the set of views on the left. Again, it shall be noted that a reticle 24 is disposed in each of the scopes 2, 4. The upper set of views shows the result of aiming the reticle 24 of the second scope 2 at the center of a bullseye at a target plane 16 disposed at a distance by making adjustments via a horizontal adjustment turret 44 and a vertical adjustment turret 46 of the second scope 2. For the first scope, the horizontal adjustment turret 44 allows adjustment of the reticle horizontally to coincide with the bullseye 18 while the vertical adjustment turret 46 allows adjustment of the reticle vertically to coincide with the bullseye 18. In the configuration shown, the shooter 12 may access the horizontal adjustment turret 44 of the first scope easily via a right hand. As the vertical adjustment turret 46 of the first scope is disposed on the right hand side of the shooter 12, it may be easier for the shooter 12 to use his right hand to access the vertical adjustment turret 46. The horizontal adjustment turret 44 of the second scope is disposed on the left side of the scope and is more conveniently accessed using a left hand. In this configuration, the horizontal adjustment turret 44 is now used for adjusting the reticle of the second scope in the vertical direction. The vertical adjustment turret 46 of the second scope is disposed on top of the second scope and is also more conveniently accessed using a left hand. In this configuration, the vertical adjustment turret 46 is now used for adjusting the reticle of the second scope in the horizontal direction. The shooter 12 may alternatively mount the second scope such that the orientations of the horizontal and vertical adjustment turrets of the second scope are identical to those of the first scope. Referring to FIG. 6, upon having aimed the reticle 24 of the second scope 2 at the center of a bullseye at a target plane 16, the shooter 12 proceeds to fire a first shot of the projectile device to create a first point of impact 26 at the target plane 16 as shown in the view through the first scope. Referring now to FIG. 7, the reticle 24 of the first scope is aimed at the center of the point of impact 26. The set of views on the left depict a process where horizontal and vertical adjustments are being made via horizontal and vertical adjustment turrets, respectively, such that the reticle 24 coincides with the point of impact 26 as shown on the set of views on the right. The zeroing of the projectile device 6 is now complete. FIG. 8 is a view depicting a subsequent shot being fired from the projectile device. It shall be noted that the shot impacts a second point of impact aimed at with the reticle of the first scope at the target plane 16 where the second point of impact coincides with the first point of impact 26. It shall be now be clear that a second scope may be mounted atop or alongside a first scope of a projectile device to enable zeroing of the projectile device.

Figure 9:
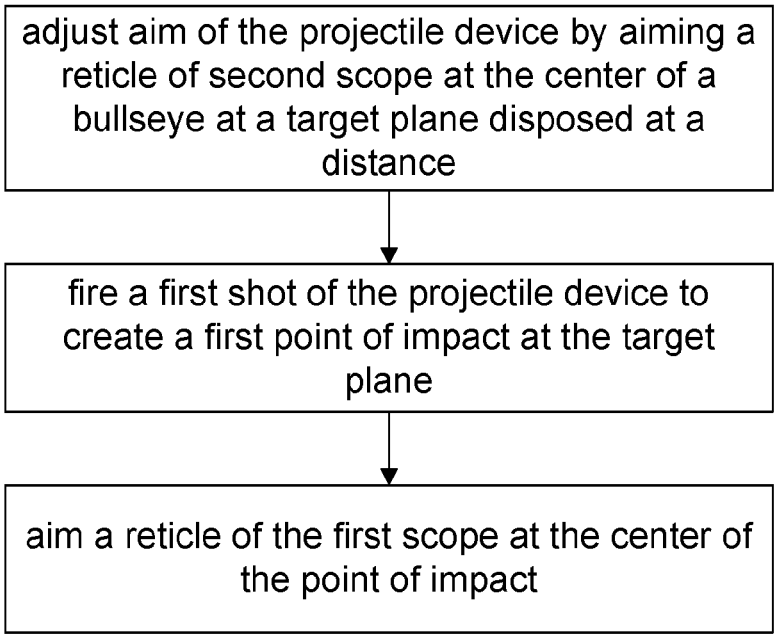
FIG. 9 depicts a method for zeroing a projectile device.

It can then be summarized that a projectile device can be sighted in or zeroed with a method shown in FIG. 9 where the projectile device is equipped with two scopes, a secondary scope mounted atop of or alongside a primary scope. A target plane is erected or set up at a distance for which a projectile device is to be zeroed. A bullseye is marked on the target plane before the projectile device is pointed towards the target plane such that the bullseye appears within the view through the secondary scope. The aim of the projectile device is adjusted by aiming a reticle of the second scope at the center of a bullseye at a target plane disposed at the distance. A first shot is then fired of the projectile device to create a first point of impact at the target plane. A reticle of the first scope is then aimed at the center of the first point of impact. The projectile device is now zeroed for the distance. This is verified by firing a subsequent shot from the projectile device to create a second point of impact. If the second point of impact coincides with the first point of impact, the zeroing process is considered a success.

This process is effective for any target distance at which a bullseye can still be readily discerned through the scope used. In one embodiment, the target distance is a distance of up to about 300 yards with a scope magnification factor of about 18. Without a parallax mitigating device or a parallax elimination aid, a scope is designed for a specific distance. When viewed through the scope, the image of an object disposed at a distance for which the scope is designed becomes clear. Without a parallax elimination aid, the effectiveness of a zeroing device is limited to the distance for which the scope is designed. When combined with a parallax elimination aid, a present zeroing device can be used for zeroing a projectile device at any distance as the distance for which the projectile device is zeroed does not affect the effectiveness of the system and method. Each of the scopes used in the present zeroing device does not need to be made specifically for the distance to which the projectile device is zeroed. Therefore scopes of any magnification factors can be used for zeroing a projectile device for any distance.

Figure 10:
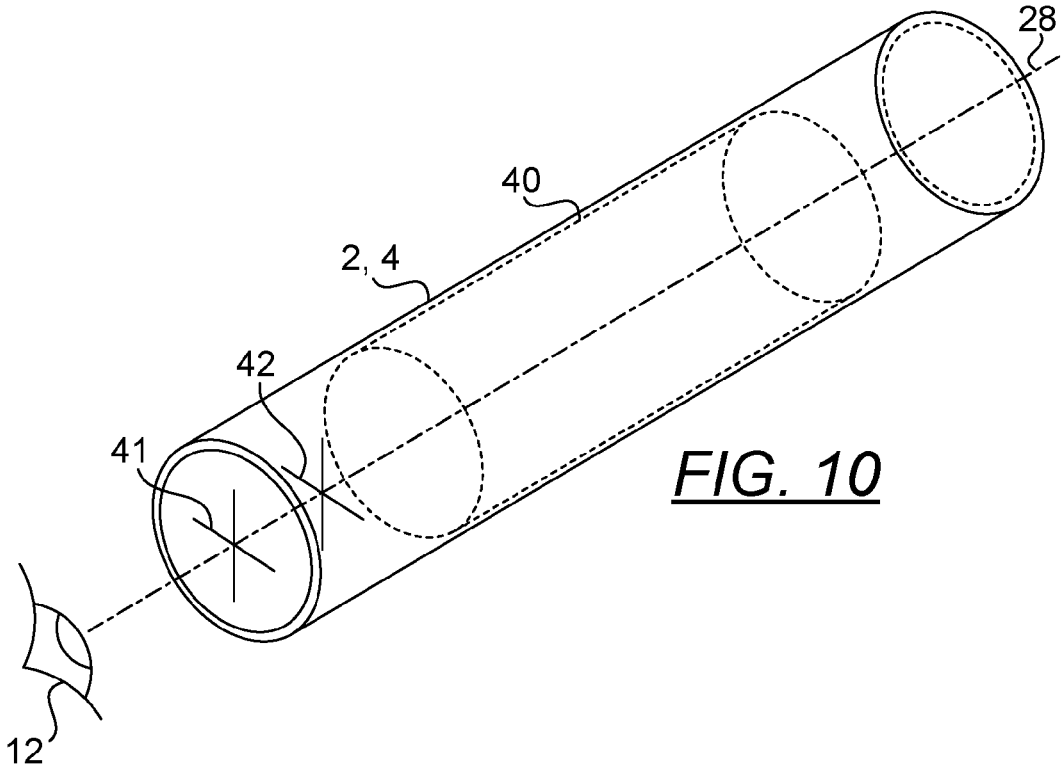
FIG. 10 is a top rear perspective of a telescope depicting one embodiment of a parallax elimination aid.

FIG. 10 is a top rear perspective of a telescope depicting one embodiment of a parallax elimination aid. In this example, the parallax elimination aid is a reticle 42 whose center coincides with the optical axis 28 of the scope. In one embodiment, such aid 42 can be applied to a scope already equipped with a reticle 41. Note that in this embodiment, both of the reticles are interposed between the shooter 12 and the image erecting optics 40. In one embodiment, the adjusting step further includes aligning the reticle 41 of the second scope with a parallax elimination aid 42. In one embodiment, the aiming step further includes aligning the reticle 41 of the second scope with a parallax elimination aid 42. The use of a parallax elimination aid removes the need for a scope designed specifically for a particular distance and one that must be focused precisely at a bullseye of a target plane placed at a distance. A ubiquitous scope having a magnification factor of about 1 to 60 can be used for a target plane disposed at any distance as long as the bullseye can be reasonably seen. In contrast to a zeroing system and method relying upon projected light, e.g., laser, images at great distances, the present zeroing system and method takes advantage of the magnification power of a second scope such that the bullseye of a target plane disposed at a great distance can be clearly seen. Further, in order to project an image at great distances, a projection-based zeroing system and method requires significant amounts of shooter-carried portable power to power one or more severely collimated light sources. Even with severe collimation, the footprints (e.g., of circular shape) cast at great distances of such light sources can be too large and/or vague that their centers cannot be readily be ascertained. A shooter using a projection-based zeroing system and method may have difficulty ascertaining centers of such references at distances greater than 25 yards, severely limiting the usefulness of such system and method. In contrast, when used with the present zeroing system and method, the center of a bullseye disposed at a target plane placed at a great distance can be easily discerned when viewed through a first scope or a second scope. A projectile device can therefore be zeroed at a distance not previously achievable. Further, no bullet drop adjustment is required for a projectile device zeroed with the present zeroing system and method.

Figure 11:
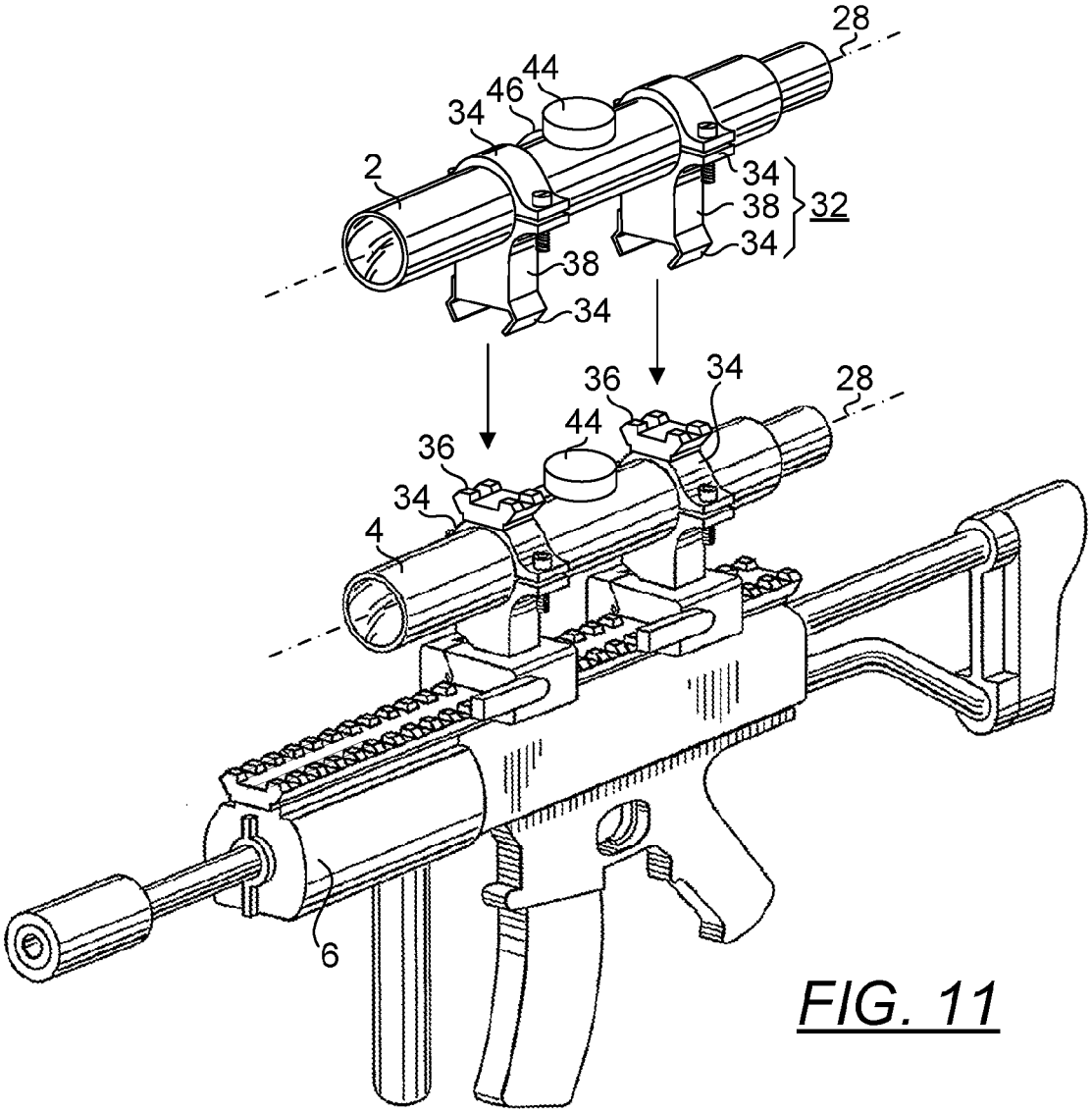
FIG. 11 is a top front perspective view depicting one embodiment of a present device configured to be mounted to a projectile device.
Figure 12:
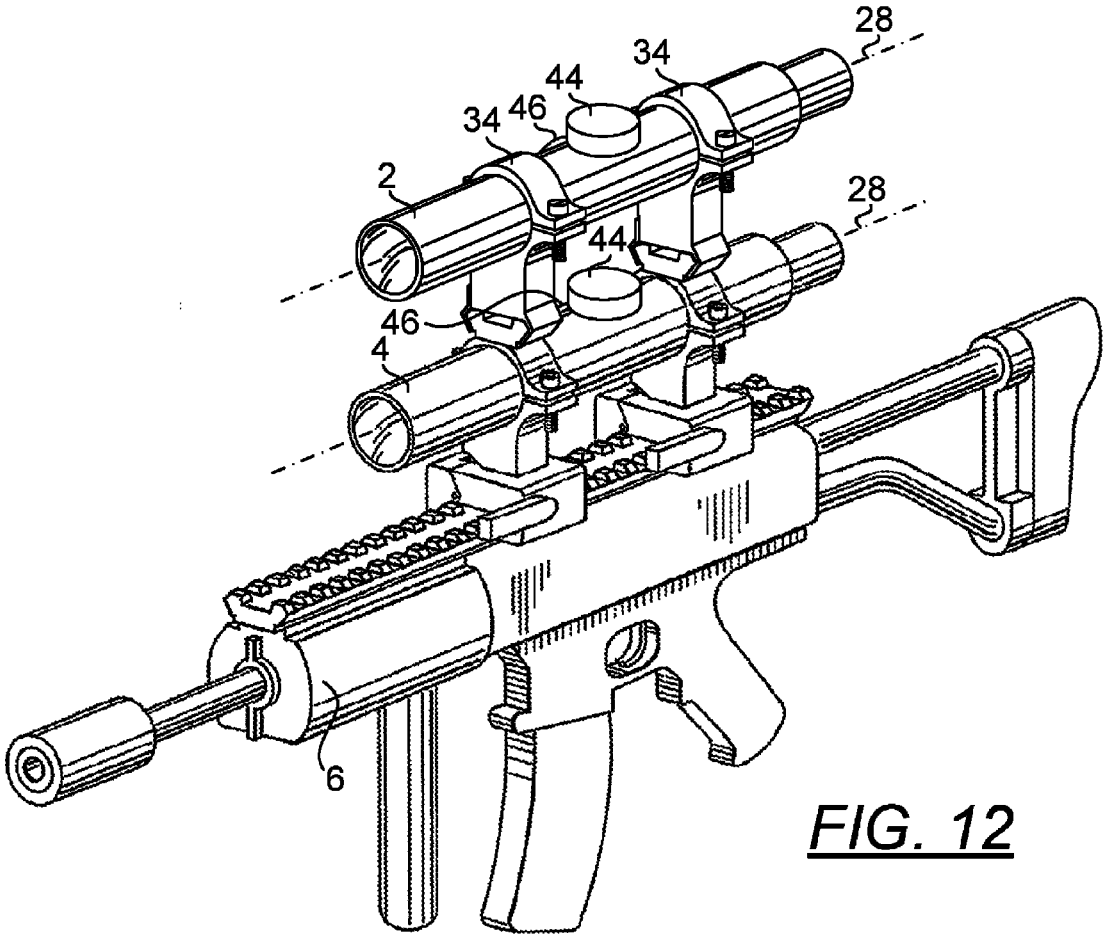
FIG. 12 is a top front perspective view depicting one embodiment of a present device shown mounted to a projectile device.
Figure 13:
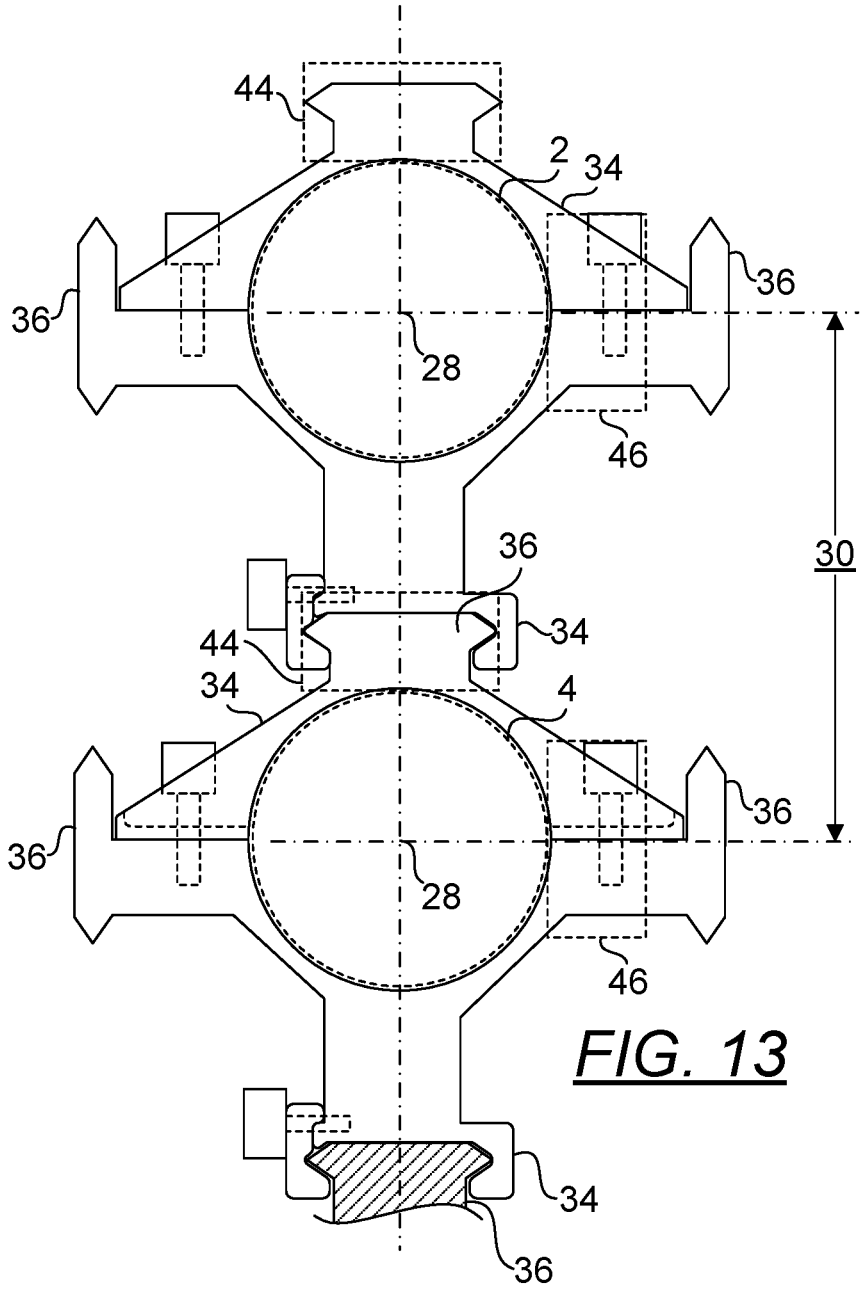
FIG. 13 is a rear view depicting one embodiment of a present device shown mounted to a first scope where the present device is mounted atop the first scope or the mounting hardware securing the first scope.

FIG. 11 is a top front perspective view depicting one embodiment of a present device configured to be mounted atop a first scope. FIG. 12 is a top front perspective view depicting one embodiment of a present device shown mounted atop a first scope. FIG. 13 is a rear view depicting one embodiment of a present device shown mounted to a first scope where the present device is mounted atop the first scope or the mounting hardware securing the first scope. An adaptor 32 is configured for securing the second scope 2 to the first scope 4 of the projectile device such that the optical axis 28 of the second scope 2 is parallel to the optical axis 28 of the first scope 4. The adaptor includes an extension rod 38 having a first end and a second end, a first clamp disposed on the first end for securing the extension rod to the second scope 2 and a second clamp disposed on the second end. The second clamp is configured for removably securing the extension rod 38 to the first scope 4. In one embodiment, the second clamp includes a Picatinny rail adaptor 34. In another embodiment, the adaptor includes an extension rod having a first end and a second end, a clamp, the extension rod extending at the first end from the second scope and the clamp is disposed on the second end. The second clamp is configured for removably securing the second scope to the first scope or the projectile device. In this embodiment, the rod is integrally built with the second scope. In another embodiment, the adaptor includes two clamps configured for securing the second scope to the first scope of the projectile device or the projectile device itself. The two clamps are configured to be spaced apart a distance along the optical axis of the scope to which the two clamps are secured. This distance is adjustable as the clamps can be secured to different locations along the outer structure or barrel of the scope. With at least two clamps, the second scope can be suitably secured to the first scope or the projectile device. Further, in the embodiment shown in FIGS. 11 and 12, the locations at which the clamps are applied along the length of scopes are alterable such that scopes of various makes, models and styles, e.g., with different configurations of adjustment turrets and bell-shaped ends, etc., can be accommodated.

Figure 14:
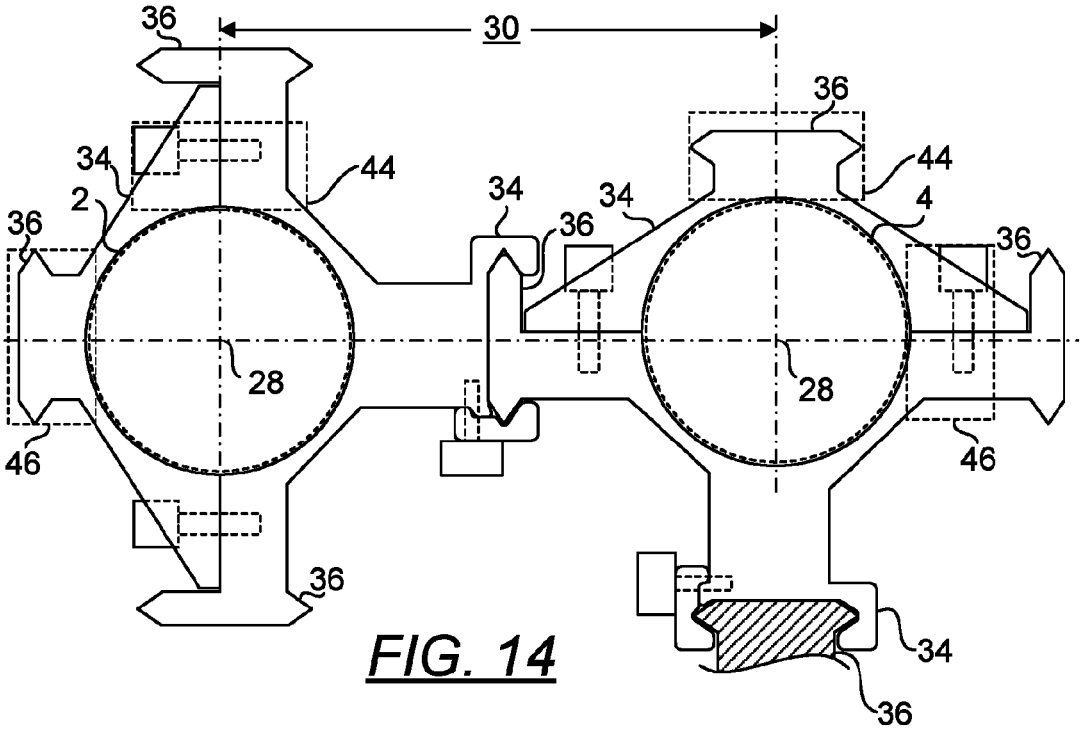
FIG. 14 is a rear view depicting one embodiment of a present device shown mounted to a first scope where the present device is mounted alongside and to the left side of the first scope or the mounting hardware securing the first scope.
Figure 15:
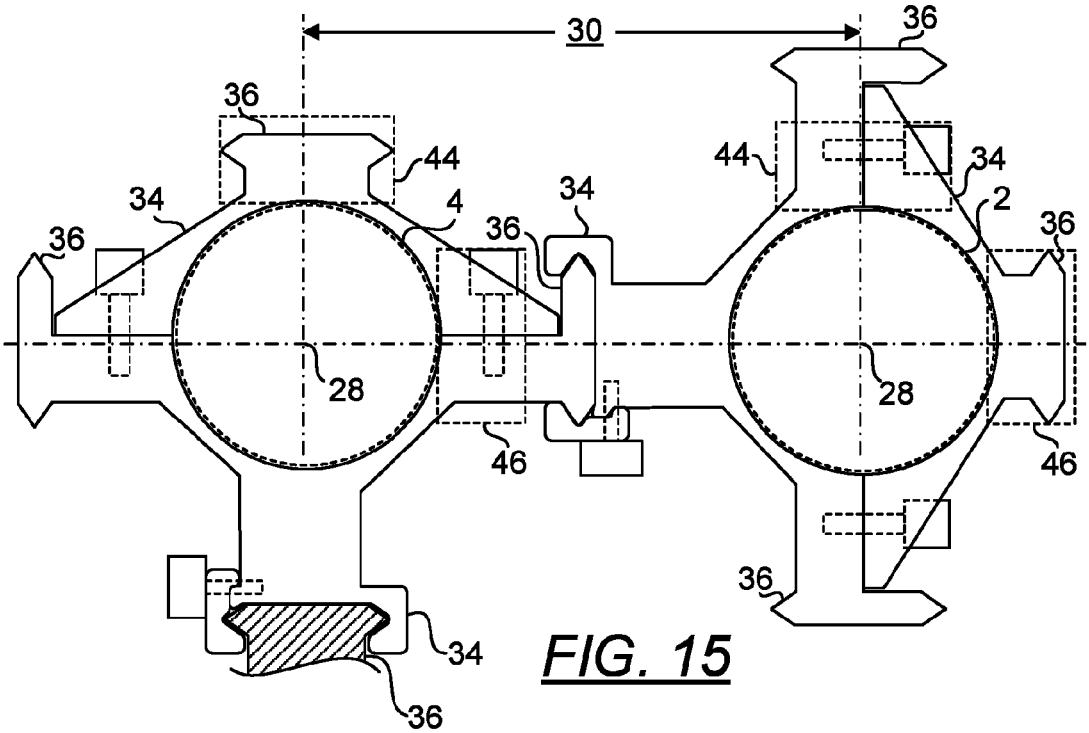
FIG. 15 is a rear view depicting one embodiment of a present device shown mounted to a first scope where the present device is mounted alongside and to the right side of the first scope or the mounting hardware securing the first scope.

FIG. 14 is a rear view depicting one embodiment of a present device shown mounted to a first scope where the present device is mounted alongside and to the left side of the first scope or the mounting hardware securing the first scope. FIG. 15 is a rear view depicting one embodiment of a present device shown mounted to a first scope where the present device is mounted alongside and to the right side of the first scope or the mounting hardware securing the first scope. It shall be noted that when mounted properly, the optical axes 28 of the first and second scopes will be disposed in a parallel configuration. In one embodiment, the distance 30 between the optical axes 28 shall be about 2 inches.

Figure 16:
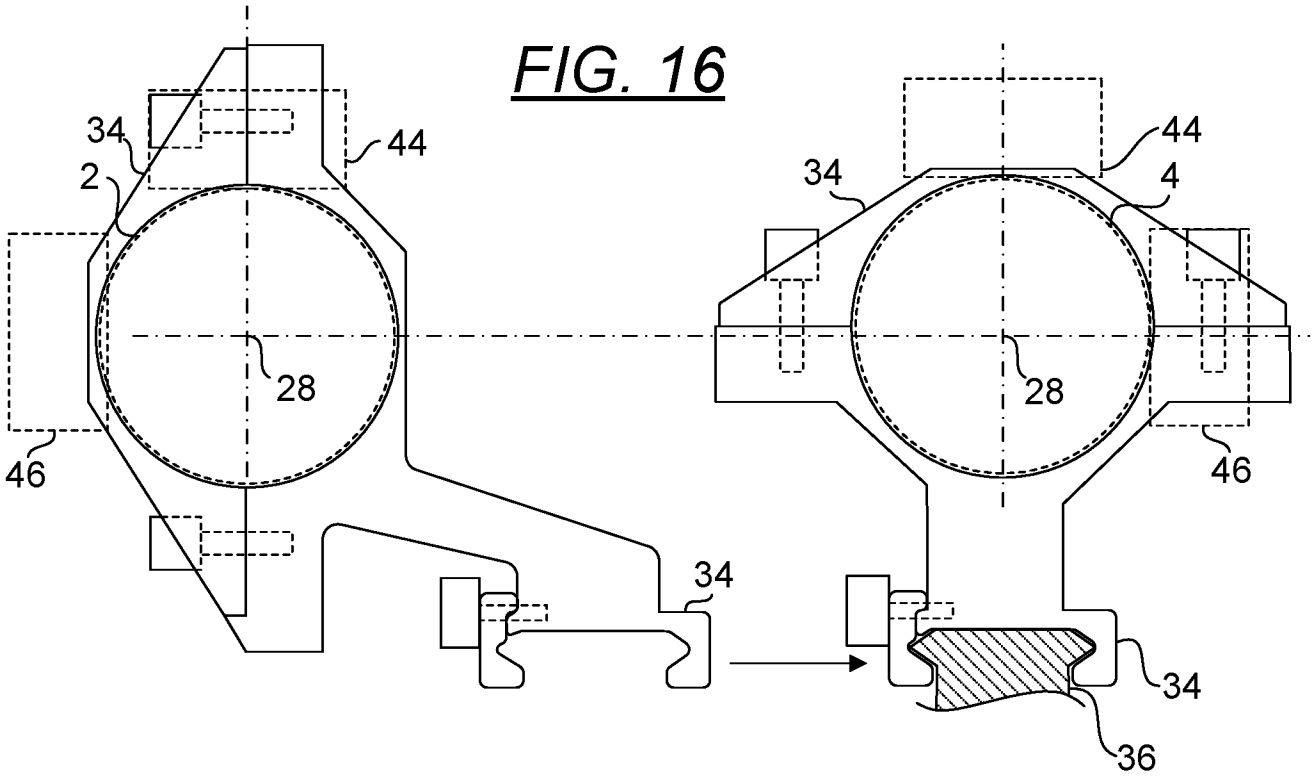
FIG. 16 is a rear view depicting one embodiment of a present device shown mounted to a first scope where the present device is mounted alongside and to the left side of a first scope.

FIG. 16 is a rear view depicting one embodiment of a present device shown mounted to a first scope where the present device is mounted alongside and to the left side of the first scope onto a rail secured to the projectile device. It shall be noted that the second scope 2 is secured directly to a rail 36 which is secured to the projectile device although this configuration is less desirable as more materials will be needed in constructing the adaptor connecting the second scope directly to the projectile device.

Figure 17:
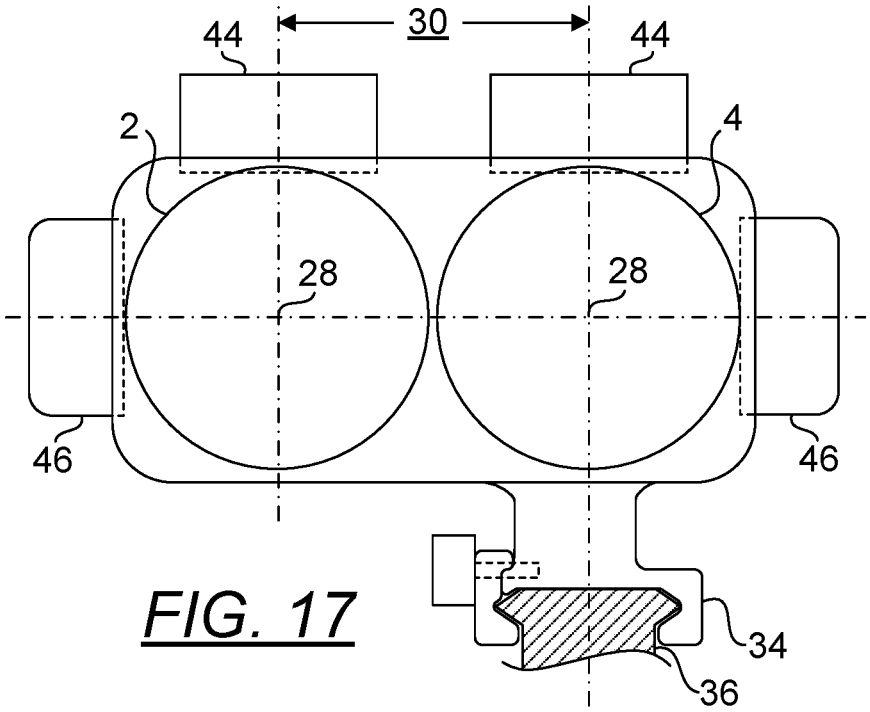
FIG. 17 is a rear view of yet another embodiment of a present device depicting a two-scope configuration.

FIG. 17 is a rear view of yet another embodiment of a present device depicting a two-scope configuration. The device includes two scopes disposed side-by-side with the optical axes 28 of the scopes 2, 4 in parallel configuration. An adaptor extends coplanarly with the optical axis 28 of the first scope into a clamp 34, i.e., a Picatinny rail adaptor, for securing the device onto a rail 36 secured to a projectile device.

Figure 18:
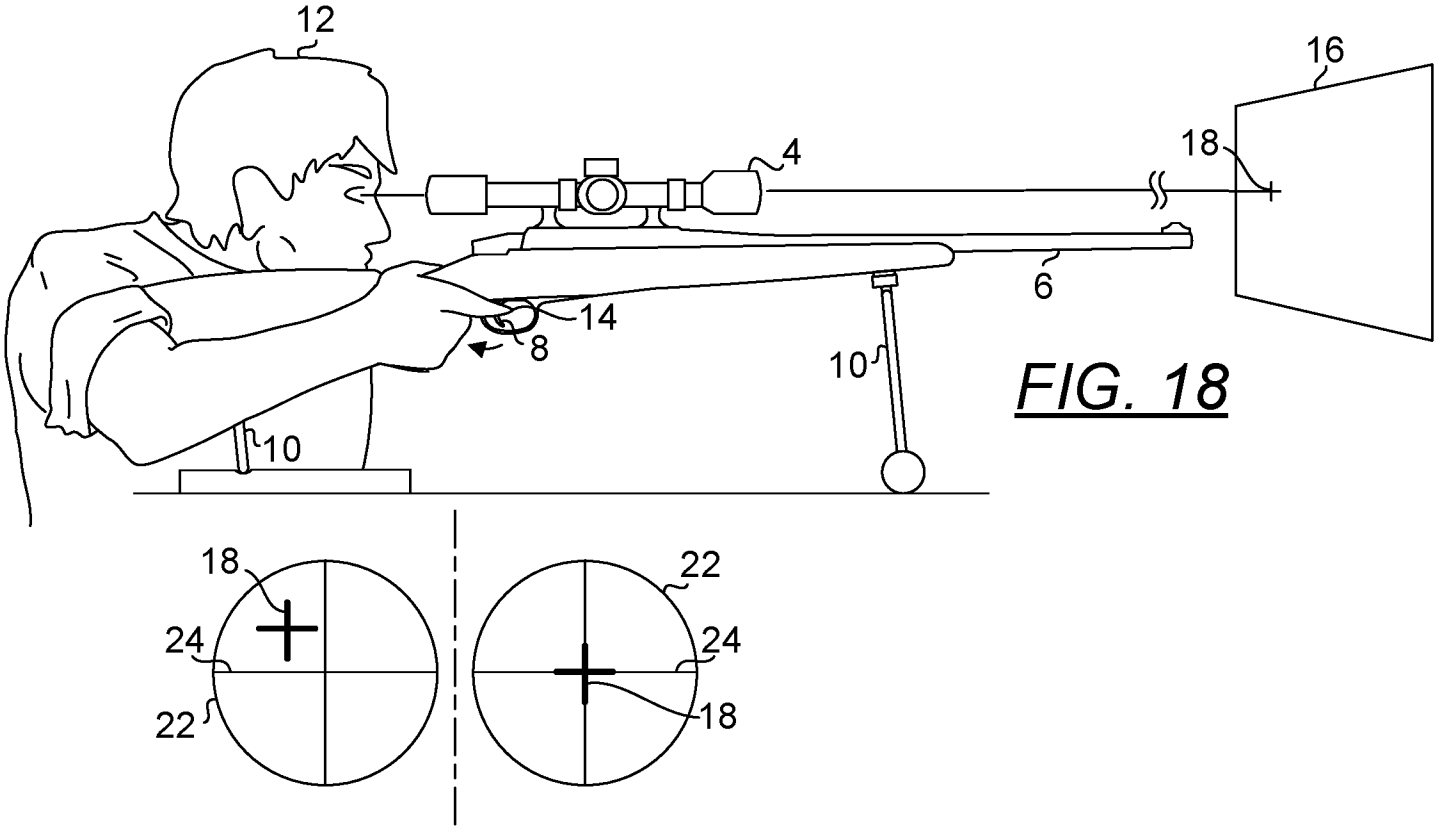
FIGS. 18-21 are diagrams depicting another embodiment of a method for zeroing a projectile device, wherein a side view of a first scope or a second scope is shown adapted for use with zeroing, a target as it is aligned with the second scope and corresponding views through the second scope and the first scope to which the second scope is attached in the figures.
Figure 19:
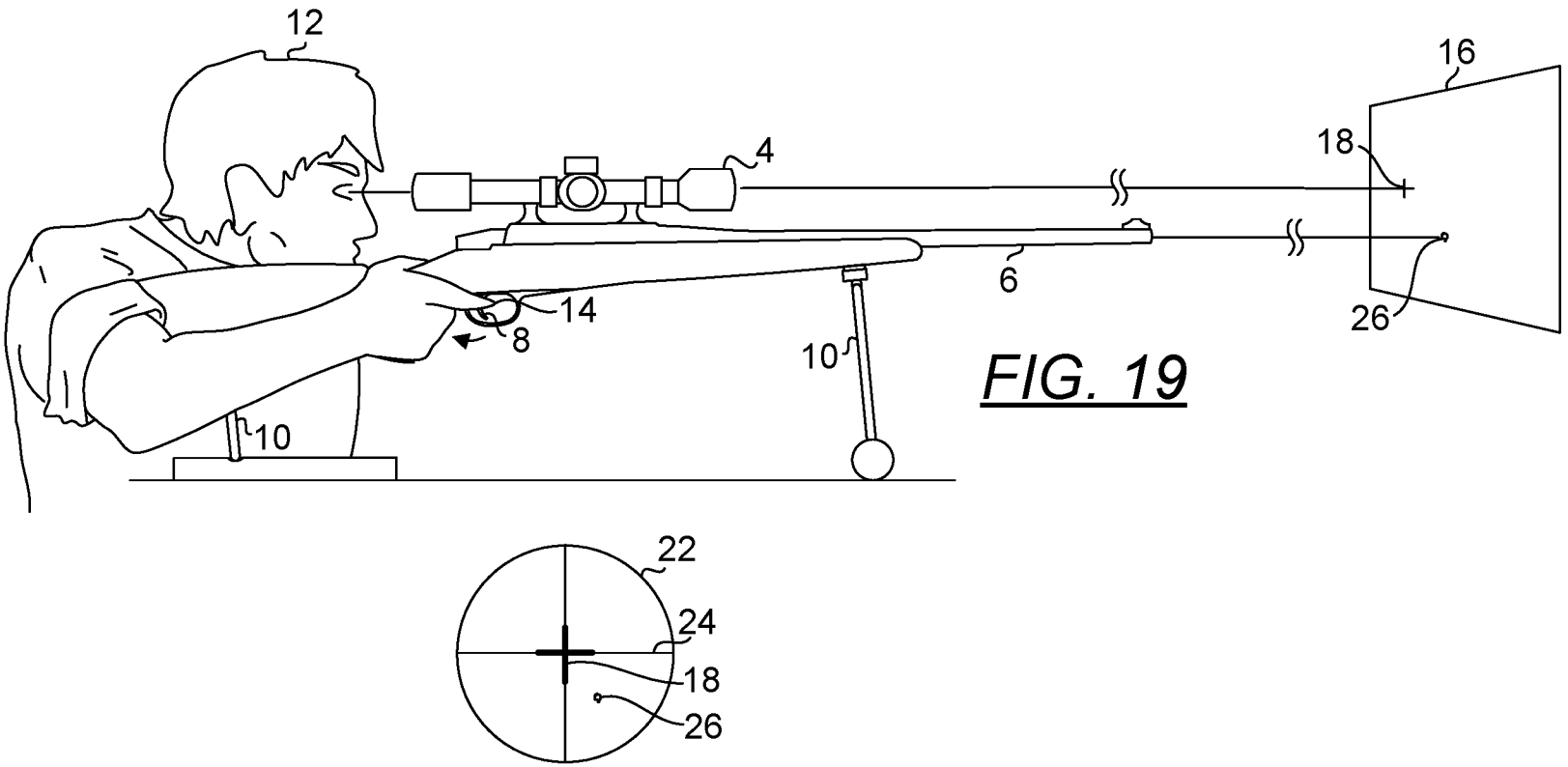
Figure 20:
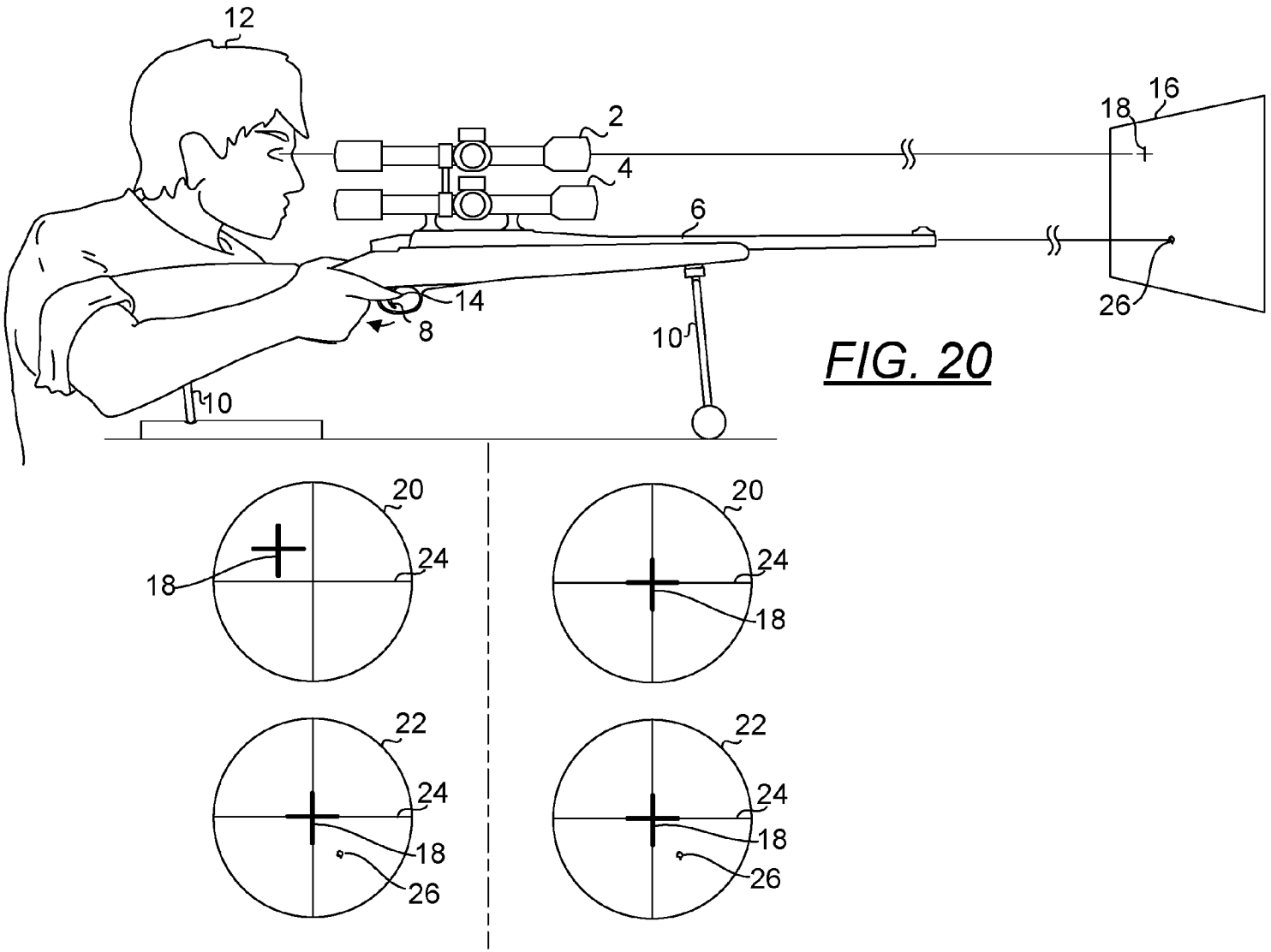

FIGS. 18-20 are diagrams depicting another embodiment of a method for zeroing a projectile device, wherein a side view of a first scope or a second scope is shown adapted for use with zeroing, a target as it is aligned with the second scope and corresponding views through the second scopes and the first scope to which the second scope is attached in the figures. In FIG. 18, a bullseye 18 disposed at a target plane 16 appears in the view 22 through the first scope as shown on the view on the left. It shall be noted that only a view through the primary scope 22 is shown as only the primary scope is necessary for performing this step. The right view shows the result of aiming the reticle 24 of the first scope 4 at the center of a bullseye at a target plane 16 disposed at a distance by making adjustments via a horizontal adjustment turret 44 and a vertical adjustment turret 46 of the first scope 4. The bullseye can include, but not limited to, a pair of crosshairs or any mark or marks capable of indicating the location of their physical center. The horizontal adjustment turret 44 allows adjustment of the reticle horizontally to coincide with the bullseye 18 while the vertical adjustment turret 46 allows adjustment of the reticle vertically to coincide with the bullseye 18. Referring now to FIG. 19, upon having aimed the reticle 24 of the first scope 4 at the center of a bullseye at a target plane 16, the shooter 12 proceeds to fire a first shot of the projectile device to create a first point of impact 26 at the target plane 16 as shown in the view through the first scope. A second scope 2 is then attached to the first scope 4. Notice that this is done after a shot has been taken. Therefore, the second scope 2 is not subject to shock or any ill effects that can potentially be caused by recoil. The adaptor used for attaching the second scope 2 to the first scope 4 can be fabricated to a lower quality, thereby reducing the cost for such attachment. For instance, an adaptor equipped with only one clamp may be used instead of one having two clamps. FIG. 20 depicts a step after a second scope has been attached to the first scope. While holding the aim of the reticle of said first scope 4 at the center of the bullseye 18 at the target plane 16, a reticle of the second scope 2 is aimed at the center of the bullseye 18 at the target plane 16. The set of views on the left depict a view 20 through a second scope that has just been installed. The set of views on the right depict a process where horizontal and vertical adjustments have been made via horizontal and vertical adjustment turrets, respectively, such that the reticle 24 coincides with the center of the bullseye 18 as viewed though the second scope 2.

Figure 21:
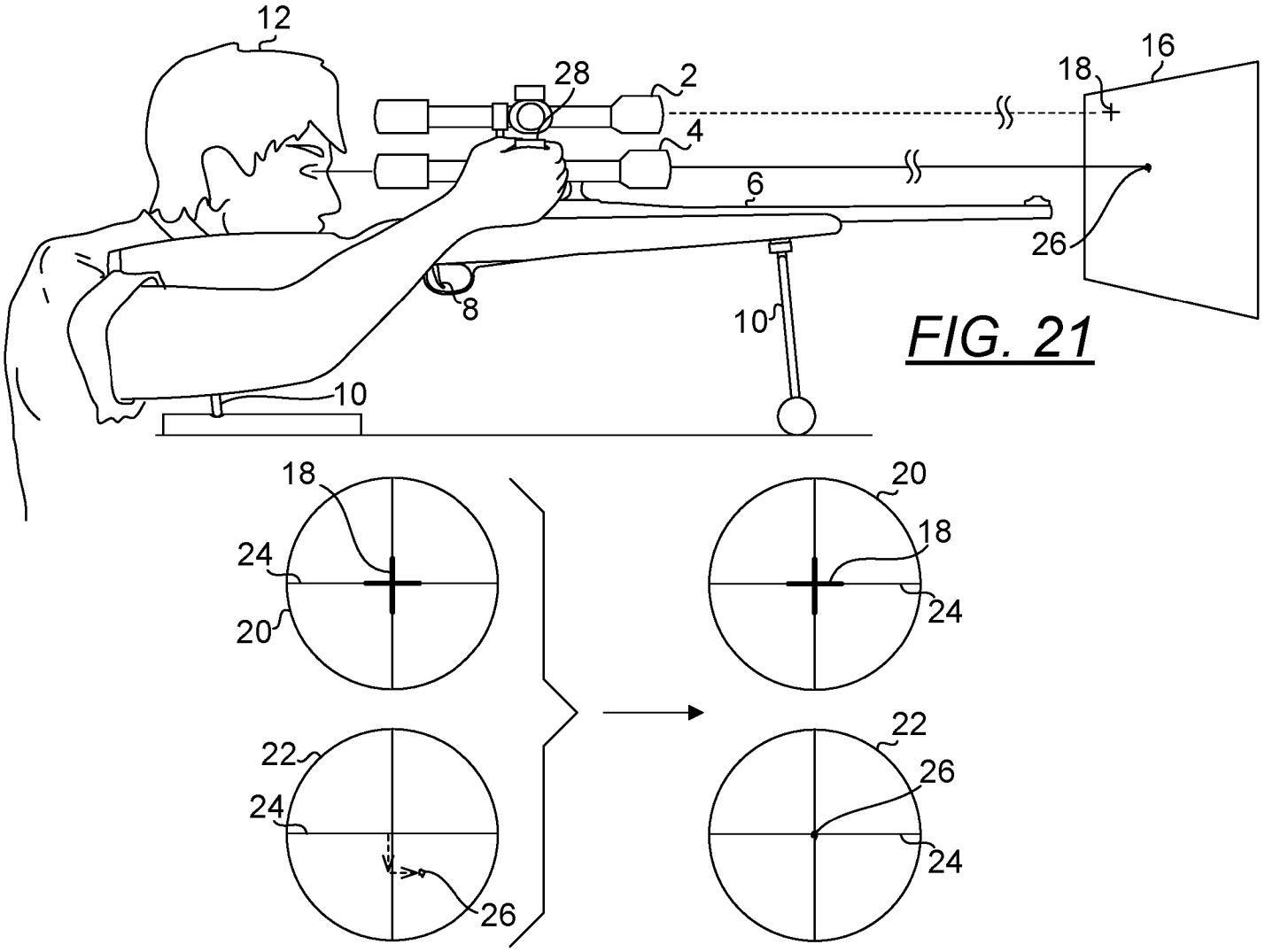

Referring now to FIG. 21, the set of views on the left depicts a process where horizontal and vertical adjustments are being made via horizontal and vertical adjustment turrets, respectively, such that the reticle 24 of the first scope 4 coincides with the point of impact 26. The projectile device 6 is now zeroed. Again, a parallax elimination aid, e.g., one shown in FIG. 10 may be used on any of the scopes 2, 4.

Figure 22:
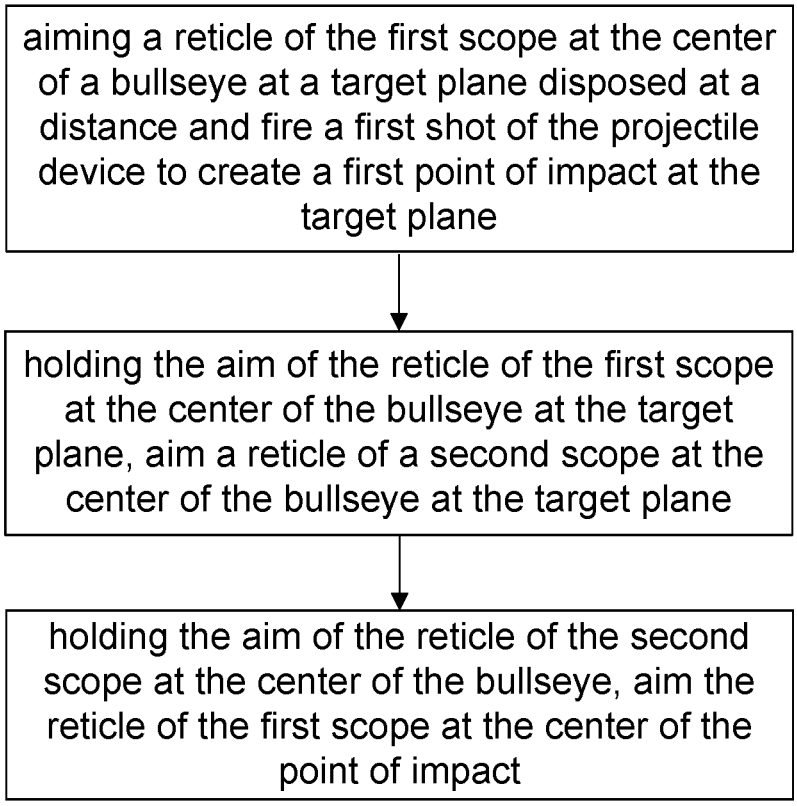
FIG. 22 depicts another method for zeroing a projectile device.

FIG. 22 summarizes the method for zeroing a projectile device including the use of a first scope and a second scope as shown in FIGS. 18-20. The first step involves adjusting the aim of the projectile device by aiming a reticle of the first scope at the center of a bullseye at a target plane disposed at a distance and firing a first shot of the projectile device to create a first point of impact at the target plane. Then, while holding the aim of the reticle of the first scope at the center of the bullseye at the target plane, a reticle of the second scope is aimed at the center of the bullseye at the target plane. Finally, while holding the aim of the reticle of the second scope at the center of the bullseye, the reticle of the first scope is aimed at the center of the point of impact. A subsequent shot fired from the projectile device is configured to impact a second point of impact aimed at with the reticle of the first scope at the target plane.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A method for zeroing a projectile device having a first scope and a second scope, said method comprising:

(a) adjusting the aim of the projectile device by aiming a reticle of said first scope at the center of a bullseye at a target plane disposed at a distance and firing a first shot of the projectile device to create a first point of impact at said target plane;

(b) holding the aim of the reticle of said first scope at the center of the bullseye at the target plane and aiming a reticle of said second scope at the center of the bullseye at the target plane; and (c) holding the aim of said reticle of said second scope at the center of the bullseye and aiming the reticle of said first scope at the center of the point of impact, wherein a subsequent shot fired from the projectile device is configured to impact a second point of impact aimed at with the reticle of the first scope at the target plane.

2. The method of claim 1, wherein at least one of said adjusting step, said first holding step and said second holding step further comprises aligning the reticle of at least one of said first scope and second scope with a parallax elimination device.

3. The method of claim 1, wherein at least one of the first scope and the second scope is selected from the group consisting of a mechanical scope, a digital scope and a night vision-enabled scope.

4. The method of claim 1, further comprising an adaptor for securing one of the first scope and the second scope to the projectile device.

5. The method of claim 4, wherein the first scope comprises a first optical axis and the second scope comprises a second optical axis and said adaptor is configured for securing the second scope to the first scope such that the second optical axis is parallel to the first optical axis.

6. The method of claim 4, wherein said adaptor comprises an extension rod having a first end and a second end, a first clamp disposed on said first end for securing said extension rod to the second scope and a second clamp disposed on said second end, said second clamp is configured for removably securing said extension rod to the first scope.

7. The method of claim 6, wherein said second clamp comprises a Picatinny rail adaptor.

8. The method of claim 4, wherein said adaptor comprises an extension rod having a first end and a second end, a clamp disposed on said second end, said extension rod extending at said first end from the second scope and said second clamp is configured for removably securing the second scope to one of the first scope and the projectile device.

9. The method of claim 4, wherein said adaptor comprises two clamps configured for securing the second scope to one of the first scope and the projectile device, said two clamps are configured to be spaced apart a distance along a second optical axis of the second scope, said distance is configured to be adjustable.

10. The method of claim 4, wherein the second scope further comprises a parallax elimination aid.

11. The method of claim 10, wherein said parallax elimination aid of the second scope comprises a second reticle configured to be paired with a first reticle of the second scope, said second reticle having a center coinciding with a second optical axis of the second scope.

12. The method of claim 4, further comprising a parallax elimination aid adapted to the first scope.

13. The method of claim 12, wherein said parallax elimination aid of the first scope comprises a second reticle configured to be paired with a first reticle of the first scope, said second reticle having a center coinciding with a first optical axis of the first scope.

* * * * *